US009748062B2

(12) United States Patent
Pinto, IV et al.

(10) Patent No.: US 9,748,062 B2
(45) Date of Patent: Aug. 29, 2017

(54) SURFACE TEMPERATURE-RESPONSIVE SWITCH USING SMART MATERIAL ACTUATORS

(71) Applicant: GM GLOBAL TECHNOLOGY OPERATIONS LLC, Detroit, MI (US)

(72) Inventors: Nicholas W. Pinto, IV, Shelby Township, MI (US); Richard J. Skurkis, Lake Orion, MI (US); Nancy L. Johnson, Northville, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 14/855,637

(22) Filed: Sep. 16, 2015

(65) Prior Publication Data

US 2016/0093186 A1 Mar. 31, 2016

Related U.S. Application Data

(60) Provisional application No. 62/057,455, filed on Sep. 30, 2014.

(51) Int. Cl.
*G08B 17/06* (2006.01)
*H01H 37/32* (2006.01)

(52) U.S. Cl.
CPC ..... *H01H 37/323* (2013.01); *H01H 2225/012* (2013.01)

(58) Field of Classification Search
CPC ..... G01K 5/483; H01H 37/323
USPC ..... 340/584, 593, 679, 680, 682; 374/187, 374/188, 195, 205; 361/103; 116/216
See application file for complete search history.

(56) References Cited

U.S. PATENT DOCUMENTS

| | | | | |
|---|---|---|---|---|
| 5,735,607 | A * | 4/1998 | Shahinpoor | G01K 5/483 116/216 |
| 6,561,121 | B1 * | 5/2003 | Rose | G01K 13/08 116/216 |
| 9,058,729 | B2 | 6/2015 | Johnson et al. | |
| 9,097,593 | B2 | 8/2015 | Johnson et al. | |
| 2014/0340802 | A1 * | 11/2014 | Suissa | G01K 5/52 361/103 |

FOREIGN PATENT DOCUMENTS

JP H02291630 A 12/1990

* cited by examiner

*Primary Examiner* — Thomas Mullen
(74) *Attorney, Agent, or Firm* — Reising Ethington P.C.

(57) ABSTRACT

Malfunction or failure of mechanical, electrical, and electromechanical equipment, for example, equipment used in manufacturing operations, is often preceded by an increase in the operating temperature of at least some portion of the equipment. A temperature-sensitive, active material-containing actuator is pre-selected to operate at a pre-determined temperature indicative of impending equipment failure and placed in thermal contact with the equipment. If the equipment achieves the pre-selected temperature the actuator signals this by closing an externally-powered circuit to enable or provide a suitable alarm signal. Additionally, the actuator may close a second circuit connected to a machine controller to alert the machine controller to take some pre-programmed action. Selected actuators are based on shape memory alloys (SMA) adapted to operate over a temperature range sufficient to encompass the expected range of pre-determined temperatures.

20 Claims, 3 Drawing Sheets

SURFACE TEMPERATURE-RESPONSIVE SWITCH USING SMART MATERIAL ACTUATORS

This application claims priority based on provisional application 62/057,455, titled "Surface Temperature-Responsive Switch Using Smart Material Actuators" filed Sep. 30, 2014 which is incorporated herein by reference.

TECHNICAL FIELD

This disclosure pertains to temperature-sensitive devices adapted to fit on machinery or equipment, such as is used, for example, in manufacturing operations. Each fitted-device responds to the surface temperature of the equipment and serves to give notice of overheating of the equipment to which it is attached or thermally connected. More specifically, this disclosure pertains to devices in which selected materials that are physically transformed at a predetermined machine-overheat temperature, respond by directly operating a switch which completes an electrical connection to an alarm-giving or warning device. The switch may be further connected to signal a machine controller of the overheat condition so that the machine controller may trigger an alarm, log the overheating event, or execute a pre-programmed response.

BACKGROUND OF THE INVENTION

Modern manufacturing operations and other operating devices use many types of equipment that are subjected to loads that cause heating in portions of the particular machine or unit. Sometimes the heating occurs in electrically powered equipment, such as electric motors, welding transformers, and welding guns. The heating may also occur in equipment such as gear boxes, bearings, and machining equipment that experience frictional loading. Often the equipment is used in circumstances that make maximum use of its design capabilities and may result in substantial heat generation within a particular heavily loaded, manufacturing unit. Further, the equipment may be expected to operate with minimal operator attention or oversight.

In many cases the equipment may be shrouded by shields, casings, or guards which render visual monitoring difficult, or the equipment may be located where physical and/or visual access is limited.

Thus, there is a need for inexpensive and low energy-consuming devices that may be adapted to function autonomously as temperature monitors, providing a remote, machine-specific, overheat signal or over-temperature signal. There is a need for such devices to fit, non-obtrusively, on the equipment, or in thermal communication with the equipment, or within the equipment. Such devices should trigger a warning signal, preferably in a central or well-trafficked location, if, or when, some portion of the equipment reaches a temperature that is likely to be harmful to its continued operation and indicates an overheating condition.

SUMMARY OF THE INVENTION

This invention pertains to a temperature-responsive device which, on reaching a predetermined temperature, operates a switch connected to an alarm-giving electrical circuit and triggers an alarm signal. The device is to be mounted on, or otherwise positioned in thermal communication with, a piece of machinery or equipment, and the predetermined operating temperature of the device is selected to be indicative of an overheating condition in the piece of machinery or equipment. A shape-changing, linear, shape memory alloy (SMA) element serves as a temperature-responsive actuator. The SMA element will, as it heats from ambient temperature, change shape if the machinery overheats and the predetermined temperature is reached. The shape change of the SMA element will operate a switch. The switch may, when operated, directly trigger the alarm, or, for machines operating under the control of a programmable controller, may signal the controller to trigger an alarm. Optionally, the controller may be pre-programmed to undertake other actions such as shutting the equipment down or reducing the load on the equipment in addition to triggering the alarm.

The linear SMA element may, in one embodiment, be a wire. Such a wire, if pre-stretched at a temperature less than its predetermined temperature, will contract and shorten to recover its initial length when heated from less than its predetermined temperature, to, or above, its predetermined temperature. Many SMA alloy compositions are known and may be employed in practice of the invention, but one suitable composition is an alloy of nickel and titanium in nearly equal atomic proportions, commonly known as Nitinol In an exemplary and non-limiting embodiment, the device incorporates a thermally-conductive, sheet metal housing with a generally rectangular base which may be about 25 millimeters or so by about 60 millimeters or so in size. One surface of the base, the external surface, is intended for mounting on the equipment to be monitored. A plunger-operated switch is mounted on the internal surface of the base and positioned generally centrally along the long axis of the rectangle with its plunger generally parallel to the base and with its plunger oriented so that it is generally parallel to the short axis of the rectangle. A suitable length of SMA wire, disposed generally along the long axis of the rectangle and secured to the base at its ends, is positioned very close to, and generally parallel to the interior surface of the base. In some embodiments the SMA wire may contact the base. The SMA wire is arranged so that the wire engages the switch plunger at about the SMA wire mid-point so that the SMA wire, viewed from above, adopts the shape of a 'vee' with the switch plunger at its apex.

In operation, heat generated by the operating equipment raises the temperature of the SMA wire. The equipment-generated heat is conducted through the base and some portion of that heat is conducted, through the SMA wire end attachment points to the base, as well as by conduction and/or convection along the entire length of the SMA wire due to its contact with, or proximity to, the base. Under normal machine operating conditions the temperature increase of the SMA wire will not be sufficient for the wire to attain its predetermined temperature and the SMA wire will not change shape. However, in the event of a machine overheating event, the SMA wire will attain its predetermined temperature, causing it to contract and shorten. Because of the initial 'vee' shape of the wire, any shortening of the SMA wire will open the angle between the arms of the 'vee' and apply pressure to the switch plunger. By suitable choice of SMA wire length and diameter, sufficient displacement and pressure is applied to the switch plunger to operate the switch and complete the alarm-giving electric circuit.

Other features of the housing may include protective sides and a top cover and suitable mounting features for the switch and SMA wire, as well as openings to accommodate electric wires, and connectors and features to facilitate mounting of the housing to the machine. In particular, the housing may incorporate features to enable or facilitate mounting the device base to other than flat machine surfaces. The housing may also serve to exclude or limit access of the local environment to the SMA wire to assure that the SMA wire temperature is not significantly affected by external influences.

Other objects, advantages, and embodiments of the invention will be apparent from the following detailed descriptions of illustrative embodiments of exemplary subject in-situ over-temperature devices and the environments in which they may be used.

DESCRIPTION OF PREFERRED EMBODIMENTS

Figure 1:
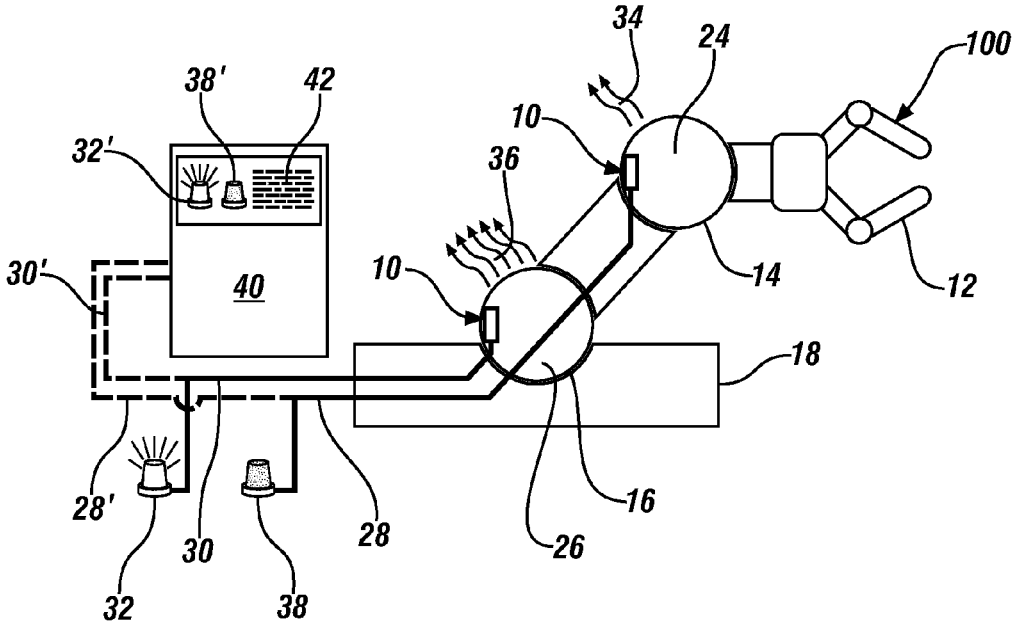
FIG. 1 shows a representation of an exemplary machine, a robot arm with at least two motors and a gripper, with an overtemperature sensor mounted on the surface of an outer casing of the robot arms at each of the two motors. One motor is shown as releasing heat in a quantity indicative normal operation and exhibiting a normal operating temperature, while the other shows excessive heat release and is in an overtemperature condition. Indicators connected to each sensor respond appropriately to the sensed temperatures and the response is (optionally) repeated on a display mounted on a machine controller cabinet.

The subject invention provides overheat-detecting devices intended for mounting in situ on a piece of equipment or machine but providing remote notification. Such devices may find application in manufacturing operations wherever equipment or devices generate heat in operation and may, if the generated heat is not dissipated, undergo some degradation in performance due to overheating. However such devices may also find application in: vehicles, for example on an electric power steering motor; consumer devices, particularly, those using electric motors, and; electronics, for example in servers. Such devices may also be used to detect abnormal operation of cooling systems, such as chillers, used to cool such equipment. As used subsequently, the terms 'machine' and 'equipment' are intended to encompass a broad range of devices, including heat-producing machine components, which may experience an overtemperature event.

The devices are shaped to be placed on a surface of the machine which would experience a temperature increase when the machine experiences a malfunction or overheats. The overheat-detecting devices use temperature-sensitive, active material actuators which experience a change in shape when heated from a reference temperature to a pre-determined temperature range. Upon undergoing such a shape change, the overheat-detecting devices operate a switch to signal an alarm or notification that the active material actuator has attained its predetermined temperature. By selecting the predetermined temperature to be indicative of machine overheating, the active material shape change may signal a machine overheat condition.

The device is intended to signal no alarm when a machine or other equipment is at, or near, a reference temperature indicative of normal machine operation, but to signal an alarm when the machine achieves a predetermined temperature which is greater than the reference temperature. Such an alarm may be a visible alarm such as a light, an audible alarm such as a siren or any combination of these, and the alarm-giving device may be mounted proximate to or remote from the machine. In some embodiments, notification of an overheating event may be communicated wirelessly from a transmitter controlled by the overheat-sensing device to a remotely located receiver. Wireless notification may include the sending of text messages, or visual, audible or haptic alerts to one or more cell-phones.

In many applications, for example in consumer devices, the reference temperature may be ambient temperature or about 20-25° C. or so. In other applications, such as a vehicle underhood application or in a manufacturing environment, the device may experience a range of temperatures from about 0° C. to about 40° C. or even higher in some extreme, untended, environments. However, in every case the reference temperature of the sensor is adapted to the prevailing temperature of the environment in which it will operate so that it will respond and provide an alarm-giving signal only when the sensor is exposed to some predetermined temperature which exceeds the prevailing temperature in which it is to be used. Preferably the predetermined, alarm-giving temperature should be at least 20° C. higher than the reference temperature.

For low temperature applications, for example those involving a chiller, it may be preferred to sense the temperature of the chilled liquid discharge from the chiller by mounting the device on a discharge pipe or a heat exchanger casing. In this case, an increase in the chilled fluid discharge temperature would indicate a loss of cooling capability and serve to indicate a problem or imminent problem with the chiller. A suitable reference temperature in this situation would be the liquid discharge temperature obtained under normal operation.

The switch may be of a normally open or normally closed type if it is connected to a logic circuit capable of recognizing a change of state of the switch. If it is a multi-pole switch, it may incorporate mixed normally open and normally closed contacts. However, where a switch operates an alarm-giving circuit directly, a normally open type switch is preferred and it is the use of such normally open switches which will be the primary, but not exclusive, focus of the following description.

By setting the pre-determined temperature as equal to a temperature corresponding to an imminent machine or equipment overheating event, the alarm or notification signals an imminent overtemperature event in the machine or equipment. Because the overtemperature-detection device is intended to be mounted external to the machine or equipment, the predetermined temperature will not the same as the machine internal temperature. An internal temperature during an overheating event will typically produce a lower temperature on the machine surface. For example, the insulation temperature rating of a class 'B' NEMA electric motor is 130° C. It is generally accepted that the casing of such a motor will be 20-30° C. cooler than the winding temperature or about 100° C. or so. Because of 'hot spots' in the winding, an allowance of 10° C. is made. With due allowance for variability in sensor response and the desire to signal an imminent, rather than an actual, overtemperature event it might be appropriate to employ an SMA wire with a transition temperature of 80° C. or so. The process of identifying such a suitable pre-determined temperature may be based on experience, such as in the example above, modeling, experiment, or any combination of these. In all cases the objective is to identify a predetermined temperature which reliably represents an overheating or imminent overheating condition. Preferably no portion of the expected range of 'normal' operating temperatures, including those operating temperatures developed under sustained operation under 100% load, will encompass the predetermined temperature.

In the majority of cases the overtemperature device will be mounted to, and in thermal communication with, an external surface of the machine or equipment. Thus a machine-by-machine, and mounting location by mounting location, correlation between surface temperature and machine-overtemperature temperature is required, so that the selected active material actuator will exhibit its intended behavior at the machine surface temperature corresponding to overheating at the mounting location. Similar correlation is required where the device is mounted on a chiller discharge pipe or heat exchanger. Less frequently the device may be mounted off the machine, for example, in the discharge cooling stream of a fan-cooled device such as an electric motor. A similar correlation of discharge stream temperature with machine overheat temperature is required with this device placement, and a similar matching of actuator operating temperature to a discharge temperature indicative of overheating is needed.

An overview of such an overtemperature detection device and its operation is illustrated schematically at FIG. 1 which shows application of the device to a robot arm 100 mounted on base 18 and comprising gripper 12, and joints 14 and 16 operated by motors 24 and 26. Mounted to the surface of an exterior casing of each of motors 24, 26 is an overtemperature detection sensor 10. Preferably the sensors may be mounted where the temperature rise due to motor operation is greatest, but it will be appreciated that options for placement of sensors 10 may be limited due to the need to not restrict the range of robot motion. However, provided the surface temperature at the selected mounting location may be correlated with the motor overheating temperature the sensor may serve its intended purpose. Again, the correlation may be made through any combination of experiment, or modeling, or experience, and a suitable predetermined temperature selected.

Sensors 10 are connected by wire pairs 28 and 30 (each shown as a single line for graphical simplicity) to alarm-giving devices 32, 38, here shown as lights. Wire pairs 28, 30 are here shown, for graphical convenience, as short, and alarm-giving devices 32, 38 are shown proximate robot 100, but the wire pairs may be of any convenient length and the alarm-giving devices may be located in any suitable location. For a simple LED display operating off a low voltage source ranging from about 3.5 volts to 12 volts and drawing less than about 250 mA wires 28, 30 may be 22 or 24 AWG wires and up to about 65 meters long with suitable current limiting resistors if needed. The wire pairs are shown mounted to the exterior of the robot arm but may also be routed internal to the robot arm.

As depicted, motor 24, operating normally, is evolving heat 34 but its casing surface temperature is insufficient to trigger sensor 10 connected to wire pair 28 and light 38, so that light 38 is unlit. Motor 26 however, is overheating, and evolving excess heat 36 which is sufficient to trigger sensor 10 connected to wire pair 30 and light 32 to give an alarm to an operator or other observer. Optionally wire pairs 28' and 30' connected to the same respective sensors 10 as wire pairs 28, 30, may be connected to machine controller 40 which may, among other approaches, repeat lit alert 32 as lit alert 32' and unlit alert 38 as unlit alert 38' in display panel 42. Other alarm-giving options are possible. For example the controller 40 may be suitably connected to a communications network so that it may provide a remote alarm via a cellphone or remote computer. Of course, such a controller 40, in addition to giving alarm, may be programmed to take action(s) to alleviate the overheating condition such as shutting the machine down or reducing its workload.

It will be appreciated that sensors 10 are, in most applications, electrically unpowered and serve only to interrupt the flow of electricity in an alarm circuit or controller/monitoring system with an associated alert device. Thus the nature of the alert device is limited only by the electrical characteristics of the alert device so that, as long as wire pairs, such as 28, 30 in FIG. 1, and the switch within sensor 10, are capable of handling the required voltage and current, suitable operation is assured. For convenience, small diameter wires such as AWG 22 and AWG 24 are preferred. This is suitable for most visual and auditory alarms, and may serve to operate a wireless transmitter if the alarm is to be communicated wirelessly, but if higher current draw alarms are used, the sensor 10 may be used to control a higher current capability switching device, such as a relay, connected to the alarm.

If sensor 10 is connected to a controller, then the controller may respond to a change in state of the switch, indicated by a change in voltage, from either open to closed, as described above, or from closed to open. Since only minimal current or power is required for such a logic circuit, use of a circuit with normally closed switch which, when the machine overheats, is opened by the SMA wire to signal an overheating condition may be considered, although use of a normally open switch is preferred.

Figure 3:
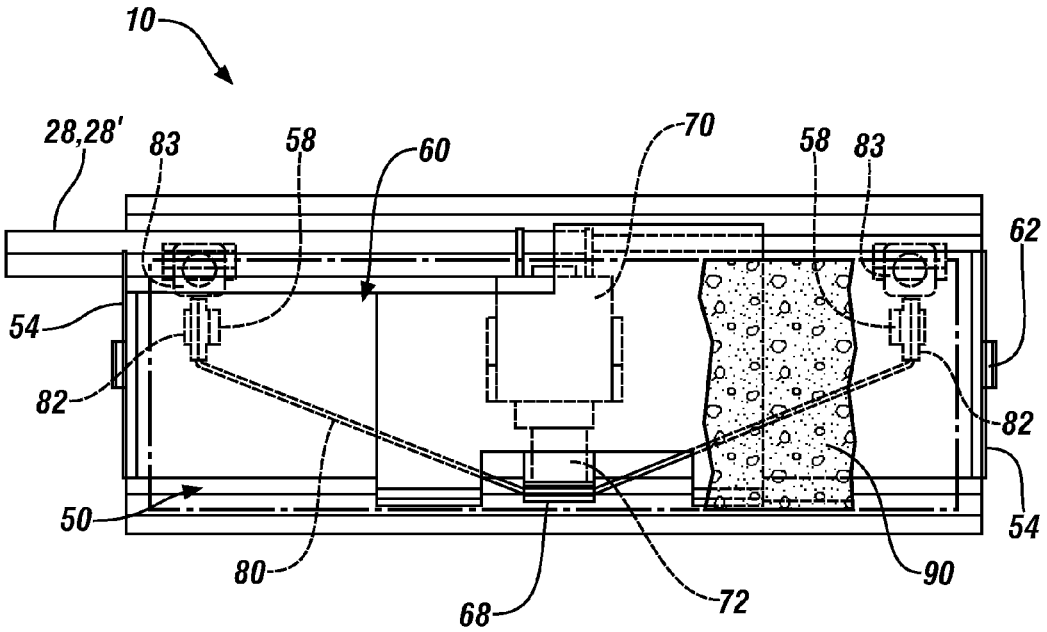
FIG. 3 shows, in plan view, the active material, SMA wire-operated, overtemperature device of FIG. 2 and further showing application of an optional insulating overlay positioned over the SMA wire.
Figure 2:
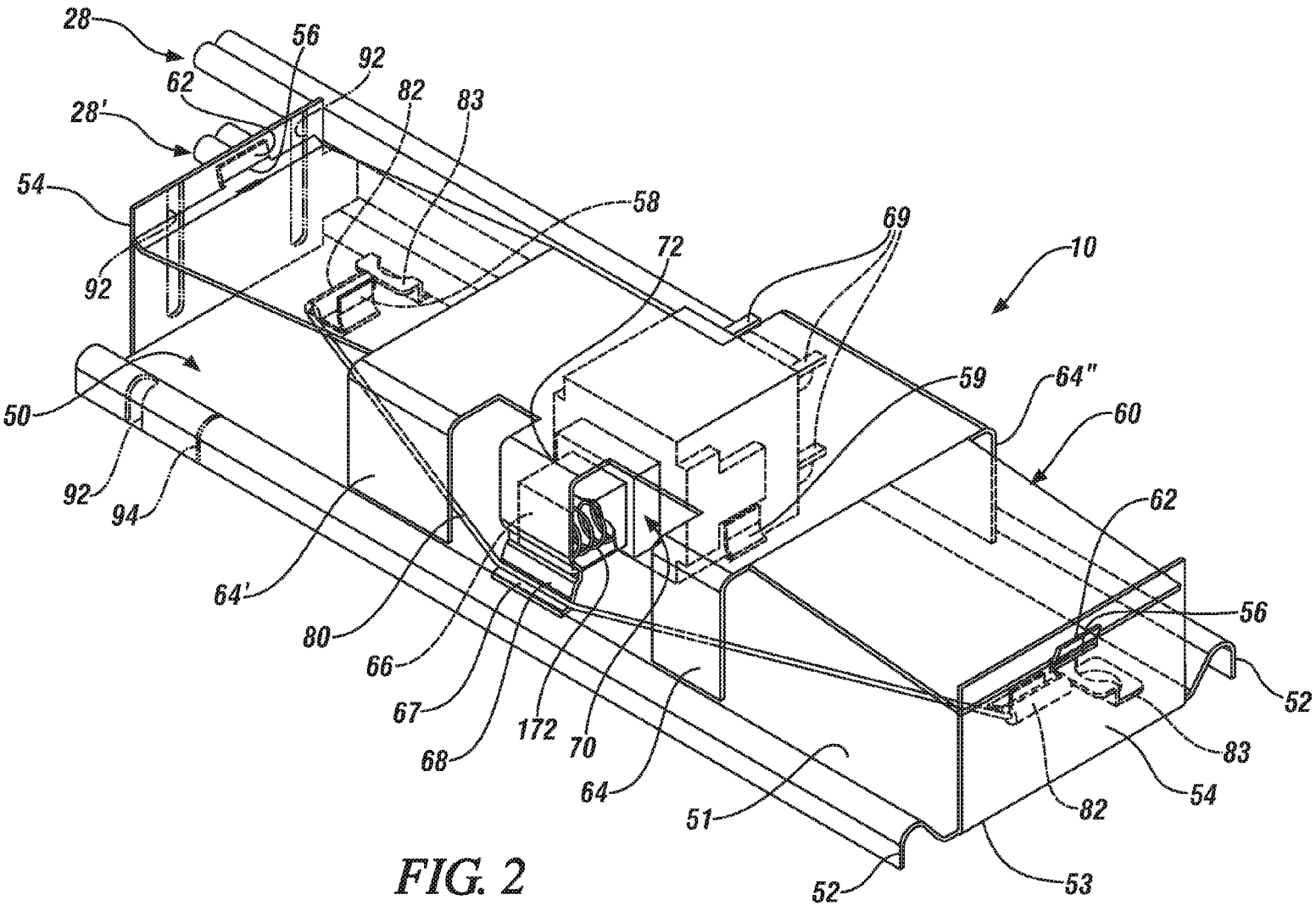
FIG. 2 shows, in perspective view, an embodiment of an overtemperature detection device comprising incoming and outgoing wire pairs connected to suitable pole of a switch secured to a base and operated by an SMA wire mechanically secured to and positioned in close proximity to the base. A cover is attached to the base so that the base and cover serve as a housing generally enclosing the switch and wire and at least partially isolating the device from its environment.

A non-limiting but representative embodiment of sensor 10 is shown in perspective view in FIG. 2 and plan view at FIG. 3. The embodiment shown has a generally rectangular footprint and is about 60 millimeters long by 25 millimeters wide, but other footprints may be used as appropriate to fit a particular machine. Switch 70, here shown as a double pole type, is a momentary contact, normally open switch and mounted to base 50 by tab portion 59 of base 50. Switch 70 incorporates a spring-loaded plunger 72 (shown in partial cut-away at FIG. 2 to illustrate spring 172) which, when depressed against the spring pressure, engages or disengages electrical contacts to modify the characteristics of the circuit in which it is included. Overlying cover 60 is secured to base 50 by tabs 62 in cover 60 which engage slots 56 in each of opposing upstanding endwall portions 54 of base 50. Cover 60 is suitably positioned over switch 70, by downstanding portions 64, 64' and opposing downstanding portion 64". Further, cover 60 and base 50 have cutouts suitable for routing wire pair 28 and, optionally, wire pair 28' to their respective contacts 69 on switch 70. An SMA element, shown as wire 80, is secured, at its ends, to base 50. The ends of wire 80 are secured to crimp fasteners 82, which, in turn, are secured to base 50 at tab portions 58 (of base 50). Crimp fastener tabs 83 may also be attached to base 50.

It will be appreciated that suitable linear SMA elements are not restricted to wires. Elongated SMA elements such as tapes, cables, springs, or chains may be substituted for wire 80 without modifying the operation of the device. The term 'SMA wire' as used in the application is intended to also embrace the use of SMA elements in these alternate configurations and geometries.

SMA wire 80 may be based on a Nickel-Titanium composition with a diameter of between about 100 and 300 micrometers with a diameter of about 150 micrometers being preferred. SMA wire 80 is configured in a taut, vee-shaped, 'bowstring' configuration with the apex of the 'we' secured in groove 67 of flex-tab 68. The angle formed by the arms of the 'vee' could range from between 5° to 175°, but preferably should lie between about 60° and 120°. Flex-tab 68 of cover 60 lightly contacts plunger 72 of switch 70 but exerts insufficient force to displace spring 172 (FIG. 2) of spring-loaded plunger 72 sufficiently to actuate the internal switch contacts (not shown).

In the embodiment shown, switch 70 is a pushbutton switch operated by a plunger 72 and the SMA wire 80 acts on flex-tab 68 to thereby operate plunger 72. However, in other embodiments, direct contact between the SMA wire and the plunger may be preferred. Also, other switch geometries, such as lever switches or toggle switches, may be substituted for pushbutton switches with minimal change to the device structure.

Shape memory alloys (SMA) are alloys of widely-varying compositions which undergo molecular rearrangement when solid, that is, they exhibit a solid state phase change. When heated and cooled through a transformation temperature or, in most cases, a narrow transformation temperature range, such alloys will switch between one of two phases which differ only in their crystal structure. The two phases which occur in shape memory alloys are called, in all alloy systems which exhibit SMA behavior, martensite, and austenite. Martensite is a relatively soft and easily deformable phase which exists at lower temperatures or temperatures below the transformation temperature. Austenite is the phase which occurs at higher temperatures or temperatures greater than the transformation temperature. Austenite is stronger and more resistant to deformation than martensite.

In future sections, the term 'transformation temperature' will denote a temperature, or a temperature range over which, on heating from the below the transformation temperature to above the transformation temperature the SMA alloy will transform from martensite to austenite, and, on cooling from above the transformation temperature to below the transformation temperature the SMA alloy will transform from austenite to martensite.

Remarkably, when an SMA in its martensite phase is deformed at a temperature below its transformation temperature and then heated above its transformation temperature, it may regain its undeformed shape. This behavior is exhibited only for small deformations of the martensite phase and generally limited to a 'reversible strain' which varies with SMA composition but is generally less than about 8%. Beneficially however, the transformation to austenite may generate appreciable force. For example, a 200 micrometer diameter wire fabricated of Nitinol, can reliably generate a force of over 5 N.

In operation, SMA wire 80 of overtemperature-detection device 10 will normally be at a temperature below its transformation temperature and in its martensite phase. Martensitic SMA wire 80 is prestrained by stretching to no more than its reversible strain and extended between base supports 58 and around flex-tab 68 while engaging groove 67 of flex-tab 68. Switch 70 should placed so that flex-tab 68 is in contact with the end 66 of plunger 72 and martensitic SMA wire 80 should be positioned so that it exhibits no or minimal slack and tautly engages, through flex-tab 68, end 66 of switch plunger 72. Preferably base supports 58 and groove 67 cooperate to maintain SMA wire 80 at least close to base surface 51. Placement of overtemperature-detection device 10 in contact with a machine or equipment will enable thermal communication between the machine and base portion 50 of the device through machine contact with base undersurface 53. Conduction, and possibly convection, will convey machine-generated heat from base portion 50 to SMA wire 80, raising its temperature. If the machine-generated heat raises the temperature of the SMA wire sufficiently to transform the SMA wire to its austenite phase, the SMA wire will seek to shrink to its un-stretched length. Because of the initial 'vee' or 'bowstring' configuration of the SMA wire, any wire shrinkage or contraction will attempt to straighten the wire and thereby apply pressure to flex-tab 68, depressing plunger 72 and closing the internal contacts to complete the circuits served by wire pairs 28, and, if present, 28'. The switch 70 is maintained in its closed configuration as long as the machine is in an overtemperature condition and the SMA wire is in its austenite phase. As noted earlier, the indirect actuation of switch 70 by the flexing action of SMA wire 80 on flex-tab 68 is exemplary and not limiting. Direct actuation of the switch 70 by SMA wire 80 is also possible, although in this mode an SMA wire-accepting guide-slot (not shown), analogous to groove 67, should be located in the SMA wire-contacting surface of plunger 72 to maintain the SMA wire in its preferred location proximate base surface 51. In this embodiment also, SMA wire 80 should be free of slack so that it may tautly engage end 66 of plunger 72.

This SMA wire behavior will serve to indicate a machine overtemperature event if the transformation temperature of the SMA wire is selected to match a machine surface temperature which occurs only when the machine is overheating, or, more preferably when the machine is on the verge of overheating. Then, if wire pairs 28, 28' are incorporated in an 'armed' alarm-giving circuit, switch contact closure of switch 70 may close the alarm-giving circuit and enable operation of one or more alarm devices such as a light, siren or other sensory-stimulating, alarm-giving device. This may be a stand-alone alarm, served for example by wire pair 28 or be an alarm circuit integrated with a machine controller or similar device served, for example, by wire pair 28'.

When the SMA wire temperature drops below the transition temperature, or transition temperature range, the wire will revert to its more readily deformed martensite phase. With appropriate choice of SMA wire gage and switch spring return pressure, the wire, which in its austenite phase could depress plunger 72 against the spring return pressure applied by spring 172, will be deformed by the spring return pressure of spring 172 to return the SMA wire and plunger 72 to their initial configuration when the wire is in its martensitic phase. This will return the contacts of the switch to their initial condition and, in the case of switch 70, break connections in the circuits served by wire pairs 28 and, if present 28' restoring the overtemperature-detection device to its initial operating configuration and ready to again signal a machine-overtemperature event when and if it occurs. If, for example, to enable manual event logging, it is desired to manually reset the device, two approaches may be followed. The momentary contact switch 70 may be replaced with a latching ON/OFF switch, or a latching circuit, as is well known to those of skill in the art, may be introduced between the switch and the alarm-signaling device.

It will be appreciated that the prestrain applied to the SMA wire, the stretched length of the SMA wire, the angle of the 'vee' or 'bowstring' and the required operating displacement of the switch must all cooperate to ensure that transformation of the SMA wire will result in sufficient displacement to operate the switch. All switches exhibit some 'lost motion' where the plunger may be depressed and displaced without opening or closing the switch contacts, so the selected configuration must accommodate the lost motion portion of the plunger travel as well as the contact-actuating portion of the travel. It is preferred that the switch also incorporate overtravel, that is, the plunger continues to move against a spring load after electrical contact is made or broken. A switch with overtravel will reduce the load on the SMA wire during the later stages of its contraction compared to a switch which 'bottoms out' immediately after contact is made or broken.

It will be appreciated that the temperature corresponding to an overtemperature event may vary from machine to machine, depending, for example, on the temperature rating of the specific grade of electrical insulation employed within the machine. Similarly, for a specific machine, its surface temperature will vary from surface to surface. Thus, the utility of the above-described approach depends upon the availability of a series of SMA alloys with a range of transformation temperatures appropriate to the needs of multiple machines and appropriate to the range of potential mounting surfaces on each such machine.

Fortunately, shape memory behavior has been observed in a large number of alloy systems including Ni—Ti and derivative alloys including Ni—Ti—Hf, as well as Cu—Zn—Al, Cu—Al—Ni, Ti—Nb, Au—Cu—Zn, Cu—Zn—Sn, Cu—Zn—Si, Ag—Cd Cu—Sn, Cu—Zn—Ga, Ni—Al, Fe—Pt, Ti—Pd—Ni, Fe—Mn—Si, Au—Zd, and Cu—Zn. Phase transformation may occur over the temperature range of from between about minus 100° C. to about plus 150° C. or so, with specialized alloys transforming at up to about 250° C.

Of these many compositions, alloys of nickel and titanium in near-equi-atomic proportion, commonly known as Nitinol, enjoy the widest use, but, even here, minor changes in composition may induce significant differences in transformation temperature. For example, changing the nickel/titanium ratio of the alloy from about 0.96 to about 1.04 may change the transformation temperature from about plus 70° C. to about minus_100° C. The transformation temperature of Nitinol-based alloys may also be modified by addition of small quantities of additional alloying elements. For example, hafnium additions may extend the high temperature operating range. Thus it is feasible to 'tailor' the properties of an SMA so that transformation occurs at whatever pre-selected temperature best correlates with the device temperature which provides the most reliable indication of impending equipment or machine failure.

Such active material actuators therefore enable a warning signal whenever a piece of equipment attains a temperature indicative of overheating. In conjunction with a suitably pre-programmed machine controller, such signal may also trigger a change in machine operation, including immediate machine shutdown, to reduce any further heat buildup, as well as enable automated data logging. Such data logging, when combined with other machine data, may support diagnostic procedures to determine the root cause of overheating and ensure that it does not re-occur.

In some cases an overtemperature-detection device may be called upon to operate in a hostile environment, where it will be exposed to adverse external environmental influences, for example on a machining center spindle where machining is conducted under flood cooling. In this situation the environment-accessible housing shown in FIGS. 2 and 3 would clearly be unsuitable since it would permit the SMA wire to be continually exposed to coolant so that the SMA wire would likely never attain its transformation temperature no matter what the machine temperature. To protect the SMA wire against exposure to such external environmental influences the sealed housing 200 shown in FIG. 4 would be suitable.

Figure 4:
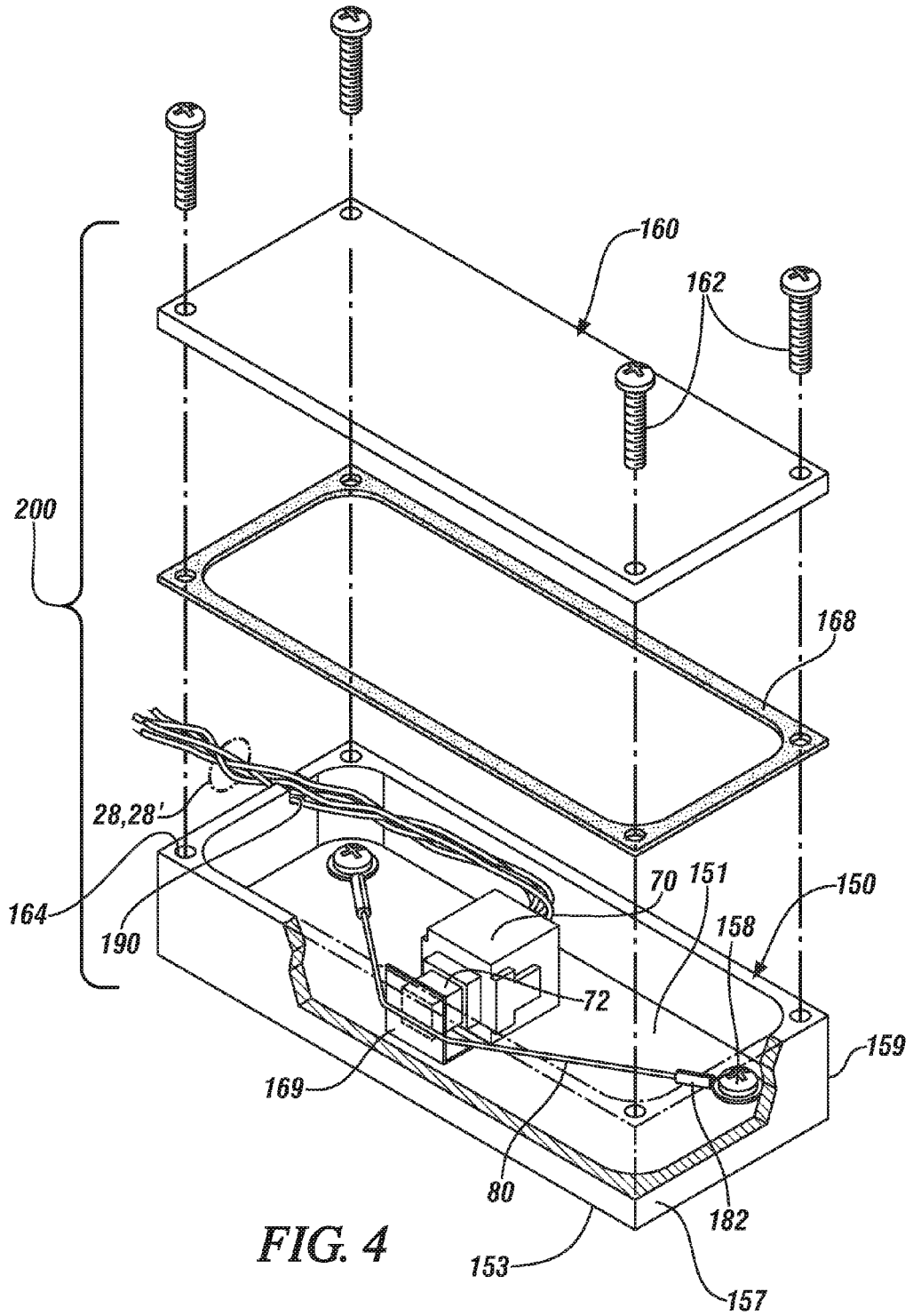
FIG. 4 shows, in perspective view an overtemperature device like that of FIGS. 2 and 3 mounted in a housing adapted for harsh environments.

In FIG. 4, the housing comprises support 150 and cover 160 which are secured to one another by screws 162. Optionally a gasket 168 may be placed between the support and cover. As shown, housing support 150 is a unitary body which has been milled from a solid block of aluminum or similar high thermal conductivity material and comprises walls 159 and base 157. Base 157 is suitably thick to accommodate screws 158 to secure crimp connectors 182 and each end of SMA wire 80 to the housing. Switch 70 may be secured to interior base surface 151 with high temperature adhesive, a mechanical fastener such as a screw, or any other suitable manner. As in the prior embodiment, the ends of pre-stretched wire 80 are secured to the base and looped around switch plunger 72 so that, in plan view, wire 80 again adopts the 'vee' shape of a tensioned bowstring. Guide 169, which may incorporate a wire-locating groove (not shown), supports and vertically positions wire 80 and facilitates applying the force generated on phase change along the axis of switch plunger 72. Wire pairs 28, 28' are routed out of base 150 through a suitably-sized notch 190 in a wall 159 of support 150.

The device is sealed by attaching cover 160 to base 150. In the figure cover 160 is secured to support 150 using screws 162 which engage complementary screw holes 164 in base walls 159, but those of skill in the art will appreciate that this is exemplary and not limiting and that other mechanical or adhesive joining methods may be used. Optionally, improved sealing of cover 160 to support 150 may be provided by positioning compressible gasket 168 between the cover and base. It may also be appropriate to also provide supplementary sealing for the wire pairs 28, 28' where they exit the housing. This may be done by routing the wires through a compliant grommet (not shown) fitted into indent 190 or, alternatively, or in combination with the grommet, to apply a dispensible sealant such as a high temperature RTV (silicone) around the wires as they exit the housing.

Because the active material actuating elements of these overheat devices respond to equipment temperature, it is essential that effective thermal contact be promoted between at least the actuator portion of the device and the manufacturing equipment that it is protecting. As shown, the housings illustrated in FIGS. 2, 3, and 4 have flat machine-contacting base surfaces 53 and 153. It will be appreciated that machine-contacting base surface 153 of housing 200 may be readily shaped, commonly by machining, to conform to any machine or machine casing surface.

The base 50 and cover 60 of overheat-detection device 10 shown in FIGS. 2, and 3, are fabricated of thin sheet or foil, typically type 304 stainless steel, or, for superior thermal conductivity, an aluminum alloy, ranging from about 100 micrometers up to 300 or so micrometers thick. Such thin material may readily flex, but to impart some structural rigidity to base 50, the two opposing long edges of the generally rectangular base may be rolled into an inverted "U" shape to form stiffening ribs 52 (shown in FIG. 2). The upstanding endwalls 54 of the opposing short edges of the rectangular base will also provide a stiffening function. These shaped stiffening features around the periphery will stabilize the shape of base 50 and maintain it as generally flat.

Base 50 may flex to accommodate a curved surface but only to a very limited extent of less than about 5° or so. If greater curvature is required the walls and rolled edges may be slit, lanced, or notched, to break these features into short segments which impart less bending stiffness. Suitable exemplary slots 92 are illustrated, in ghost in one of ribs 52 and one of endwalls 54 and a suitable exemplary slit 94 is illustrated, also in ghost, in one of ribs 52. Suitably, slots 92 may be used when the device is to be applied in a concave-down configuration on a curved surface while slits 94 are appropriate for a concave up configuration. It will be appreciated that the number and spacing of both slots 92 and slits 94 will be dictated by the curvature of the surface to which device 10 is to be attached and that the edges of slot 92 may be arranged as a 'vee' if the parallel edges of the illustrated 'U-shaped' slot interfere when the device is bent to conform to the machine.

Physical contact between the subject overheat detection device and the protected equipment may be assured by mechanical attachment, including clamps, screws, bolts, and hook and loop attachments. Physical contact between device and machine may also be maintained by welded, brazed, or soldered connections, or by adhesive attachment using either permanent or releasable adhesives as required. For example, two-sided thermally conductive tape may be used.

Thermal contact, particularly on rough or irregular equipment surfaces, may be promoted by interposing a suitable, thermally conductive medium between the device and equipment. This could include a metal; say copper, in foil or powder form, or a thermally conductive paste containing metal particles such as silver, or any other thermally conductive media known to those skilled in the art. It will be appreciated that adhesive formulations incorporating such thermally conductive particles may be used to simultaneously secure the active material device to the equipment and to promote good heat transfer.

The embodiment of FIGS. 2 and 3 has been shown as open and accessible to the external environment. With this design, a device may be placed in a discharge cooling stream, for example from an electric motor, and with appropriate choice of SMA composition, use the temperature of the discharge cooling stream as an indicator of machine overheating. Where the device is to be attached to a machine directly however, this open design may expose the SMA wire to external environmental influences as noted above. These external environmental influences may include airflows or cooling drafts originating external to the device. These externally-originating airflows, may, like the flood coolant discussed previously, reduce the SMA wire temperature and delay or prevent proper operation of the device under a machine overtemperature event. In this circumstance it may be preferred to position a layer of lightweight, temperature-resistant, readily compressible foam, such as Bisco® BF-2000 Ultrasoft silicone foam (available from Stockwell Elastomerics) or a layer of loosely packed fiberglass insulation above SMA wire 80, that is, between SMA wire 80 and the underside of cover 60. Such a layer, shown as 90 in FIG. 3, may serve to protect SMA wire 80 against exposure to such externally-originating airflows, as well as enhance thermal communication between base 50 and SMA wire 80. Such an insulating layer may also be used in the embodiment of FIG. 4 to gently urge the SMA wire into improved thermal communication with the base.

Practices of the invention have been described using certain illustrative examples, but the scope of the invention is not limited to such illustrative examples.

The invention claimed is:

1. A device for placement in thermal communication with a machine or machine component and for electrical communication with an alarm-giving circuit, the device serving to detect, and, in conjunction with the alarm-giving circuit, give notice of, an overheating condition in the machine when the machine or machine component is operating or has been operating; the device comprising:

a base with a surface for surface-to-surface contact with a surface of the machine or machine component and an opposing mounting surface, the base being thermally conductive so that heat generated by the machine or machine component may be communicated through the base;

a formed body composed of a shape memory alloy (SMA) secured to the base mounting surface, the formed shape memory alloy body being composed to experience a shape and stiffness change when it is heated from a reference temperature indicative of a normal operating temperature of the machine, to a predetermined temperature, higher than the reference temperature, the predetermined temperature being selected to be indicative of an overheating condition in the machine, the formed shape memory alloy body being heated by heat from the machine to raise the temperature of the formed shape memory alloy body to a temperature indicative of a current operating temperature of the machine;

a resettable switch secured to the base mounting surface and connectable to the alarm-giving circuit, the switch reversibly enabling two circuit states upon operation, a closed circuit state which enables passage of electricity through the circuit, and an open circuit state which denies passage of electricity through the circuit;

the switch being either a normally-open switch which, when the switch is connected to the alarm-giving circuit, in an initial condition, denies passage of electricity through the circuit until the switch is operated to render the switch in its alternate, electricity-passing, condition, or a normally-closed switch which, in an initial condition, enables passage of electricity through the circuit until the switch is operated to render the switch in its alternate, electricity passage-denying, condition; and the formed shape memory alloy body being arranged so that it engages the switch and so that the shape and stiffness change experienced by the shape memory alloy body when it is heated to the predetermined temperature, operates the switch to transition the switch to its alternate condition, the change in condition of the switch, when the switch is connected to the alarm-giving circuit, serving to signal a machine overheating condition and to operate the alarm-giving circuit.

2. The device as recited in claim 1 in which the switch incorporates a plurality of contacts, at least some of the contacts being connected through wire pairs to a plurality of individual alarm-giving devices, the switch reversibly controlling the passage of electricity in each of the plurality of individual wire pairs upon operation of the switch, one wire pair being connected to a machine controller.

3. The device as recited in claim 1 in which the composition of the formed shape memory alloy body is selected so that the temperature at which the shape memory alloy body undergoes the shape and stiffness change matches the temperature indicative of an overheating temperature of a particular machine.

4. The device as recited in claim 3 in which the composition of the shape memory alloy body is selected so that the predetermined temperature at which the shape memory alloy body undergoes the shape and stiffness change is in the temperature range from about minus 40° C. to about 200° C.

5. The device as recited in claim 3 in which the formed shape memory alloy body has the form of a wire, tape, cable, chain or spring.

6. The device as recited in claim 5 in which the-formed shape memory alloy body has a composition adapted to shorten its length when it is heated to a temperature indicative of an overheating condition in the operation of the machine, the shortening of the formed shape memory alloy body operating the switch to change the state of the switch and so operating the alarm-giving circuit.

7. The device as recited in claim 6 in which the formed shape memory alloy body is a wire with a diameter of between 100 and 300 micrometers.

8. The device as recited in claim 1 in which the formed shape memory alloy body is protected against exposure to external environmental influences by an insulating blanket placed to inhibit access of an externally-originating airflow to the formed shape memory alloy body, or, by placing the formed shape memory alloy body in a sealed housing.

9. The device as recited in claim 1 in which the switch further comprises a return spring which, when the switch is in its alternate condition, will, upon subsequent cooling of the device leading to reversal of the shape and stiffness change of the formed shape memory alloy body, operate the switch to return it to its initial condition while reshaping the formed shape memory alloy body and resetting the alarm-giving circuit so that it may detect any subsequent machine overheating event.

10. The device as recited in claim 1 in which the shape memory alloy composition comprises nickel and titanium.

11. The machine-overheating alert device of claim 1 in which the formed shape memory alloy (SMA) body is a wire, the SMA wire comprising a first straight segment, a plunger-engaging segment and a second straight segment, the straight segments being of generally equal length and oriented at an acute angle to one another, the straight segments being separated by the plunger-engaging segment, the plunger-engaging segment so engaging the plunger that as the SMA wire shortens to its initial length and the angle between the straight segments becomes less acute, the plunger-engaging segment will apply pressure along the plunger force-application axis to depress the plunger and operate the switch.

12. A device for detecting an overheating condition in an operating machine, and in conjunction with an alarm-giving circuit, providing an alert of the overheating condition in the operating machine; the device comprising:

a thin, heat-conducting, base with two opposing surfaces bounded by two opposing long edges and two opposing shorter edges, one base surface being intended for contact with and attachment to a surface of the operating machine for thermal communication between the machine and the base, and the opposing base surface being a mounting surface for a switch and a shape memory alloy (SMA) wire;

the switch being a momentary contact, normally-open switch with an operating plunger which, when depressed by application of force at a plunger end and along an axis, closes one or more pairs of complementary electrical contacts to close one or more electrical circuits, the switch comprising a spring opposing the applied force so that upon release of an applied contact-closing force the spring will open the one or more pairs of complementary electrical contacts, one pair of complementary electrical contacts being connectable to the alarm-giving circuit, the switch being secured to the mounting base surface with the plunger force-application axis being generally parallel to the mounting surface and generally perpendicular to a long edge of the base, the switch being positioned generally centrally on the base;

the SMA wire having been stretched from an initial length to an extended length and having a transition temperature at which the SMA wire will, on heating, contract from its extended length to its initial length, indicative of a machine overheating condition, the transition temperature being greater than a reference temperature indicative of a normal machine operating temperature, the wire having two ends, each end being anchored to the base at a respective anchoring location, the respective anchoring locations being generally equally spaced from the switch;

the wire being maintained generally parallel to and proximate to the base to enable thermal communication between the base and the wire so that the wire experiences a temperature indicative of the temperature of the machine surface to which the device is attached, the wire, directly or indirectly, tautly engaging the plunger, the wire being arranged to apply force along the plunger force-application axis and displace and depress the plunger when the wire is heated above the wire transition temperature, indicative of the machine overheating condition, the force and displacement applied by the wire to the switch plunger as it transitions and contracts from its extended length to its initial length being selected to depress the switch plunger to an extent at least sufficient to close the pair of complementary switch contacts connectable to the alarm-giving circuit to thereby operate an alarm and so signal that the machine is in an overheating condition when the complementary switch contacts are connected to the alarm-giving circuit including the alarm.

13. The machine-overheating alert device of claim 12 further comprising an insulating layer positioned atop the SMA wire to limit or prevent exposure of the SMA wire to externally-originating airflow.

14. The machine-overheating alert device of claim 12 in which the SMA wire comprises a first straight segment, a plunger-engaging segment and a second straight segment, the straight segments being of generally equal length and oriented at an acute angle to one another, the straight segments being separated by the plunger-engaging segment, the plunger-engaging segment so engaging the plunger that as the SMA wire shortens to its initial length and the angle between the straight segments becomes less acute, the plunger-engaging segment will apply pressure along the plunger force-application axis to depress the plunger and operate the switch.

15. The machine-overheating alert device of claim 12 in which the device further comprises a thin metal cover which is secured to the base.

16. The machine-overheating alert device of claim 12 in which the alarm is visual or auditory.

17. The machine-overheating alert device of claim 12 in which the SMA wire comprises nickel and titanium and has a diameter of between 100 and 300 micrometers.

18. The machine-overheating alert device of claim 12 in which the switch or the alarm-giving circuit comprises a latching feature so that the alarm, once triggered, continues to operate until the switch or the alarm-giving circuit is reset.

19. A device for detecting an overheating condition in an operating machine, and in conjunction with a machine controller, providing an alert of an overheating condition in an operating machine with such a controller; the device comprising:

a thin, heat-conducting, base with two opposing surfaces bounded by two opposing long edges and two opposing shorter edges, one base surface being intended for attachment to a surface of the operating machine for thermal communication between the machine and the base, and the opposing base surface being a mounting surface for a switch and a shape memory alloy (SMA) wire;

the switch being a momentary contact switch with an operating plunger which, when depressed by application of force at a plunger end and along an axis, closes or opens one or more pairs of complementary electrical contacts to close or open one or more electrical circuits, one pair of complementary electrical contacts being connectable to the controller, the switch comprising a spring opposing the applied force, so that, upon release of an applied contact-closing force the spring will open or close the one or more pairs of complementary electrical contacts, the switch being secured to the mounting base surface with the plunger force-application axis being generally parallel to the mounting surface and generally perpendicular to a long edge of the base, the switch being positioned generally centrally on the base;

the SMA wire having been stretched from an initial length to an extended length and having a transition temperature, at which the SMA wire will, on heating, contract from its extended length to its initial length, indicative of a machine overheating condition, the transition temperature being greater than a reference temperature indicative of a normal machine operating temperature, the wire having two ends, each end being anchored to the base at a respective anchoring location, the respective anchoring locations being generally equally spaced from the switch;

the wire being maintained generally parallel to and proximate to the base to enable thermal communication between the base and the wire so that the wire experiences a temperature indicative of the temperature of the machine surface to which the device is attached, the wire, directly or indirectly, tautly engaging the plunger, the wire being arranged to apply force along the plunger force-application axis and displace and depress the plunger when the wire is heated above the wire transition temperature, indicative of a machine overheating temperature, the force and displacement applied by the wire to the switch plunger as it transitions and contracts from its extended length to its initial length being selected to depress the switch plunger to an extent at least sufficient to close or open the pair of complementary switch contacts connectable to the controller, the opening or closing of the controller-connectable switch contacts signaling the controller to provide an alert of machine overheating when the controller-connectable switch contacts are connected to the controller.

20. The machine-overheating alert device of claim 19 further comprising an insulating layer positioned atop the SMA wire to limit or prevent exposure of the SMA wire to externally-originating airflow.

* * * * *